US008376491B2

(12) United States Patent
Nagai

(10) Patent No.: US 8,376,491 B2
(45) Date of Patent: Feb. 19, 2013

(54) IMAGE FORMING APPARATUS

(75) Inventor: Koji Nagai, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/228,589

(22) Filed: Sep. 9, 2011

(65) Prior Publication Data

US 2012/0062628 A1 Mar. 15, 2012

(30) Foreign Application Priority Data

Sep. 15, 2010 (JP) ..... 2010-206253

(51) Int. Cl.
*B41J 29/38* (2006.01)
*B41J 2/01* (2006.01)

(52) U.S. Cl. ..... 347/9; 347/101

(58) Field of Classification Search ..... 347/5, 9, 347/16, 101, 104, 29, 33
See application file for complete search history.

(56) References Cited

U.S. PATENT DOCUMENTS

| | | | | |
|---|---|---|---|---|
| 7,448,714 | B2 | 11/2008 | Mizuno | |
| 7,581,810 | B2 | 9/2009 | Yoshikawa et al. | |
| 8,155,542 | B2 * | 4/2012 | Itou | 399/43 |
| 2011/0148982 | A1 | 6/2011 | Katoh et al. | |

FOREIGN PATENT DOCUMENTS

| | | |
|---|---|---|
| JP | 2001-138550 | 5/2001 |
| JP | 2005-238711 | 9/2005 |
| JP | 2005-335238 | 12/2005 |
| JP | 2009-196092 | 9/2009 |

OTHER PUBLICATIONS

U.S. Appl. No. 13/164,955 of Satoshi Katoh et al., filed Jun. 21, 2011.

* cited by examiner

*Primary Examiner* — An Do
(74) *Attorney, Agent, or Firm* — Cooper & Dunham LLP

(57) ABSTRACT

An image forming apparatus is disclosed. The image forming apparatus includes at least two independent recording heads; restoring units; counting units; a restoring control unit; and a storage unit. The restoring control unit conducts a restoring operation for all of recording heads when the cumulative number of print sheets of either of the recording heads reaches the first setting value or above when the cumulative number of print sheets for all of the recording heads is less than the second setting value at the time of starting printing.

12 Claims, 11 Drawing Sheets

IMAGE FORMING APPARATUS

TECHNICAL FIELD

The present invention generally relates to image forming apparatuses and specifically relates to image forming apparatuses including recording heads which eject liquid droplets.

BACKGROUND ART

Such devices as an inkjet recording device, etc., is known as an image forming device for a printer, a facsimile machine, a reproducing unit, a plotter, and a multifunctional unit having these functions, and as a liquid ejection recording-type image forming device which uses a recording head including a liquid ejection head (a liquid droplet ejection head) that ejects ink droplets, for example. The liquid ejection recording-type image forming device ejects ink droplets from a recording head to a sheet to be conveyed (not limited to paper and includes an OHP sheet, representing what the ink droplets and other liquid, etc., can adhere to; also called a medium to be recorded on, or a recording medium, recording paper, a recording sheet) to perform image forming (recording, print, imaging, printing also used interchangeably). The liquid ejection recording-type image forming device includes a serial-type image forming device which ejects liquid droplets while the recording head moves in a main scanning direction to perform image forming and a line-type image forming device with the use of a line-type head which ejects liquid droplets while the recording head does not move to perform image forming.

Herein, the liquid ejection recording-type "image forming device" represents a device which ejects droplets to a medium such as paper, thread, fiber, cloth, leather, metal, plastic, glass, wood, ceramics, etc., while "image forming" represents not only providing a medium with an image which has a meaning, such as a character or graphics, but also providing a medium with an image which does not have a meaning, such as a pattern (merely causing a droplet to impact the medium). Moreover, "ink" is not limited to what is called ink, but all types of liquids which allow image forming, such as what is called recording liquid, fixing solution, liquid, etc., and also includes DNA samples, resist, pattern material, resin, etc., for example. Furthermore, "image" is not limited to a planar image, but also an image provided to what is formed three-dimensionally, and also an image formed by three-dimensionally shaping a solid itself.

Now, a liquid ejection-type image forming device includes a maintaining and restoring unit (a restoring unit) which includes a wiper member (also called a wiper blade, a wiping blade, a blade, etc.) which wipes off a nozzle face of a recording head to clean the nozzle face; and a cap which caps the nozzle face of the recording head in order to maintain ejection stability of a nozzle of the recording head, to prevent ink in the nozzle from drying and to prevent dust from entering into the nozzle, wherein the maintaining and restoring operation (a maintaining operation) is performed which, for instance, after draining thickened ink from the nozzle into the cap, wipes off the nozzle face with the wiper member to form a nozzle meniscus.

Herein, with respect to the timing of performing restoring operations, an apparatus is known which includes restoring processing units which can individually execute restoring operations for keeping good ink ejecting states of each of a first group of nozzle arrays and a second group of nozzle arrays using a recording head which includes the first group of nozzle arrays and the second group of nozzle arrays that eject liquid droplets of different colors; and a restoring control unit, wherein, responsive to determining that a condition for executing a restoring process is satisfied for at least one group of nozzle arrays out of the first group of nozzle arrays and the second group of nozzle arrays, the restoration control unit conducts control such that the restoring process for the condition-satisfying nozzle array group is executed, while, responsive to determining that a predetermined condition prior to when the condition for executing the restoring process has been satisfied is satisfied for the other group of nozzle arrays, the restoration control unit conducts control such that the restoring process for the other nozzle array group is executed (Patent Document 1).

It is also known to perform restoring operations on all of the recording heads when a rest time of an apparatus reaches a predetermined time or when a consecutive printing time or the number of consecutive print sheets reaches a predetermined value.

Patent Document

Patent Document 1: JP2005-238711A

Now, when an apparatus which performs a large amount of printing, such as a line-type image forming apparatus, for example, is provided with a black recording head and a color recording head and is provided with a restoring unit which performs a restoring operation independently for each of the heads, if it is arranged for executing the restoring operation when a cumulative number of print sheets reaches a predetermined number, for example, a situation arises such that the restoring operation for the color recording head is performed in a short period of time after the restoring operation of the black recording head is performed.

Now, it is possible to apply a technique disclosed in Patent document 1, so that, if a cumulative number of print sheets for one recording head reaches a predetermined number of sheets, even when the cumulative number of print sheets for the other recording head does not reach the predetermined number of sheets, but predetermined conditions are satisfied, the restoring operation is performed for both the black recording head and the color recording head.

However, in such a configuration, the restoring operation is not performed as long as the cumulative number of print sheets does not reach a predetermined number of sheets for either of the recording heads, which is not satisfactory for executing the restoring operation at an appropriate timing and, moreover, is not satisfactory from a point of view of improving throughput by reducing the number of times of restoring operations.

DISCLOSURE OF THE INVENTION

The object of the present invention is to perform restoring operations at a proper timing while reducing the number of times of restoring operations to improve throughput.

According to an embodiment of the present invention, an image forming apparatus is provided, the image forming apparatus, including:

at least two independent recording heads, each of the recording heads ejecting liquid droplets of a different color;

restoring units, each of the restoring units conducting a restoring operation of the recording heads;

counting units which count the cumulative number of print sheets printed using the recording heads since the restoring operation;

a restoring control unit which controls the restoring operation of the recording heads by the restoring units; and a storage unit which stores a first setting value of the cumulative number of print sheets that is to be a threshold for conducting the restoring operation, and a second setting value which is smaller than the first setting value, wherein the restoring control unit conducts the restoring operation for all of the recording heads when the cumulative number of print sheets of either of the recording heads reaches the first setting value or above when the cumulative number of print sheets for all of the recording heads is less than the second setting value at the time of starting printing.

The above-described embodiment of the present invention makes it possible to perform restoring operations at an appropriate timing while reducing the number of restoring operations to improve throughput.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Figure 1:
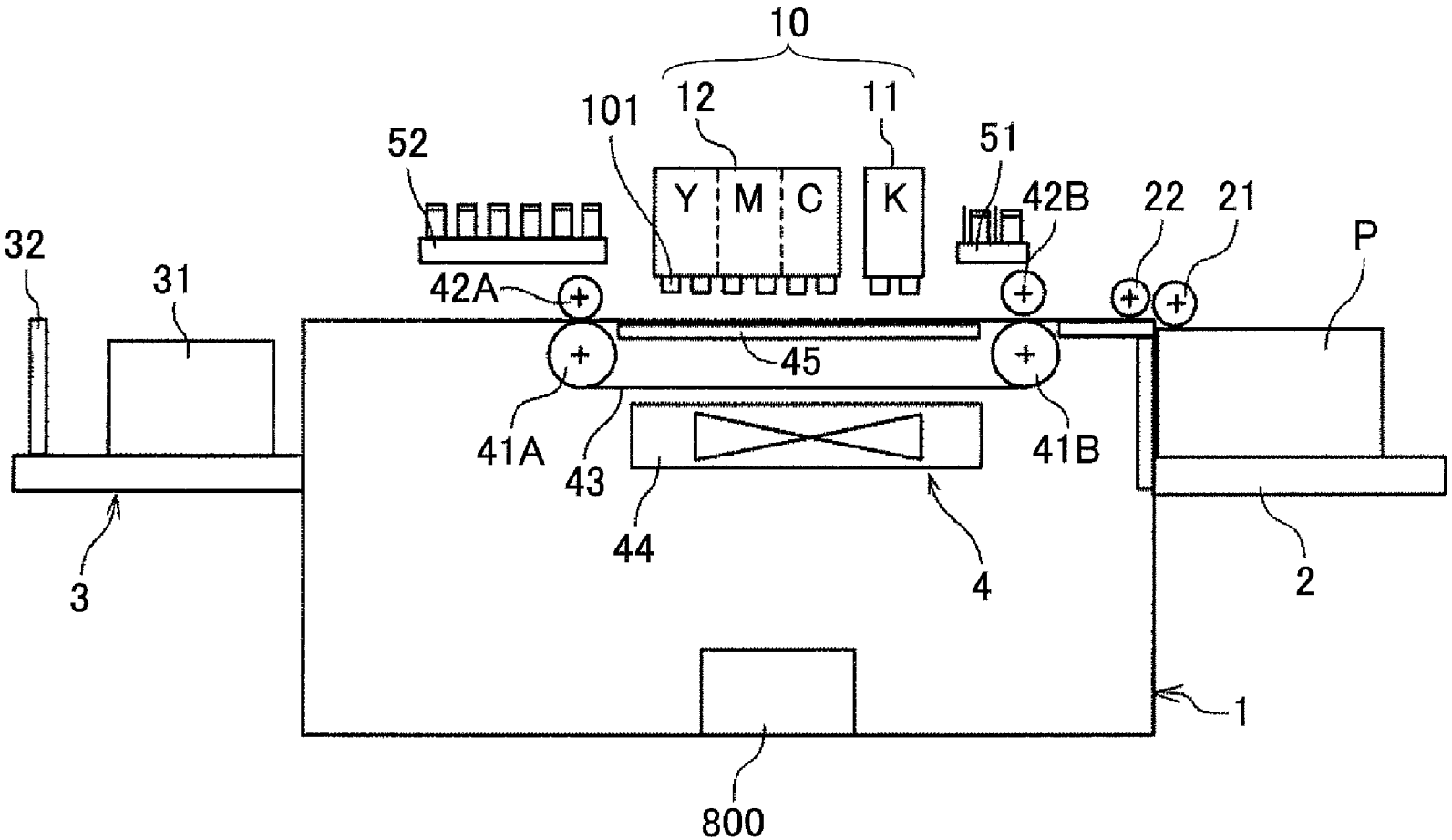
FIG. 1 is a schematic diagram illustrating an overview configuration of an image forming apparatus according to an embodiment of the present invention.
Figure 2:
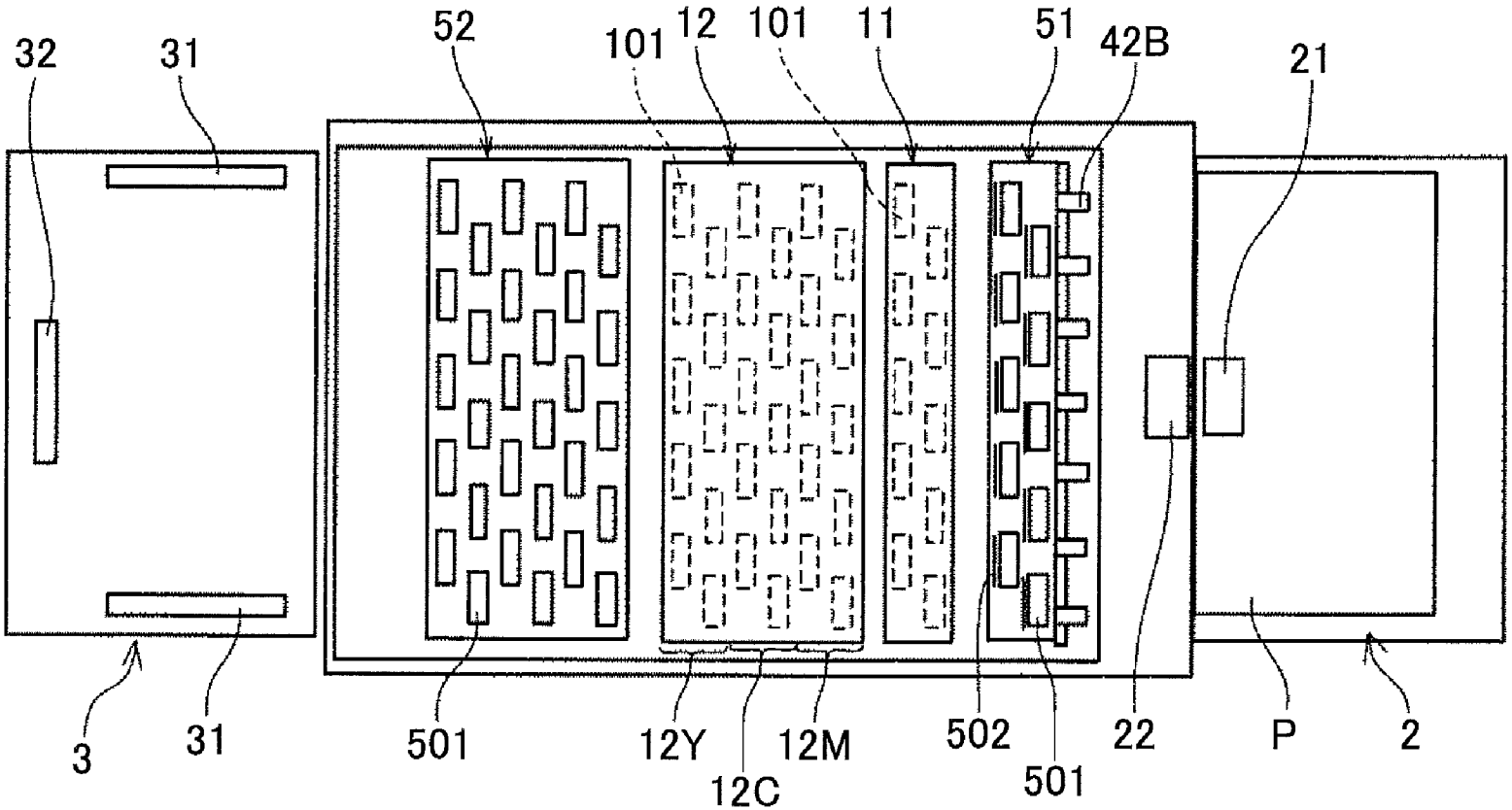
FIG. 2 is a schematic plan view illustrating the overview configuration of the image forming apparatus according to an embodiment of the present invention.
Figure 3:
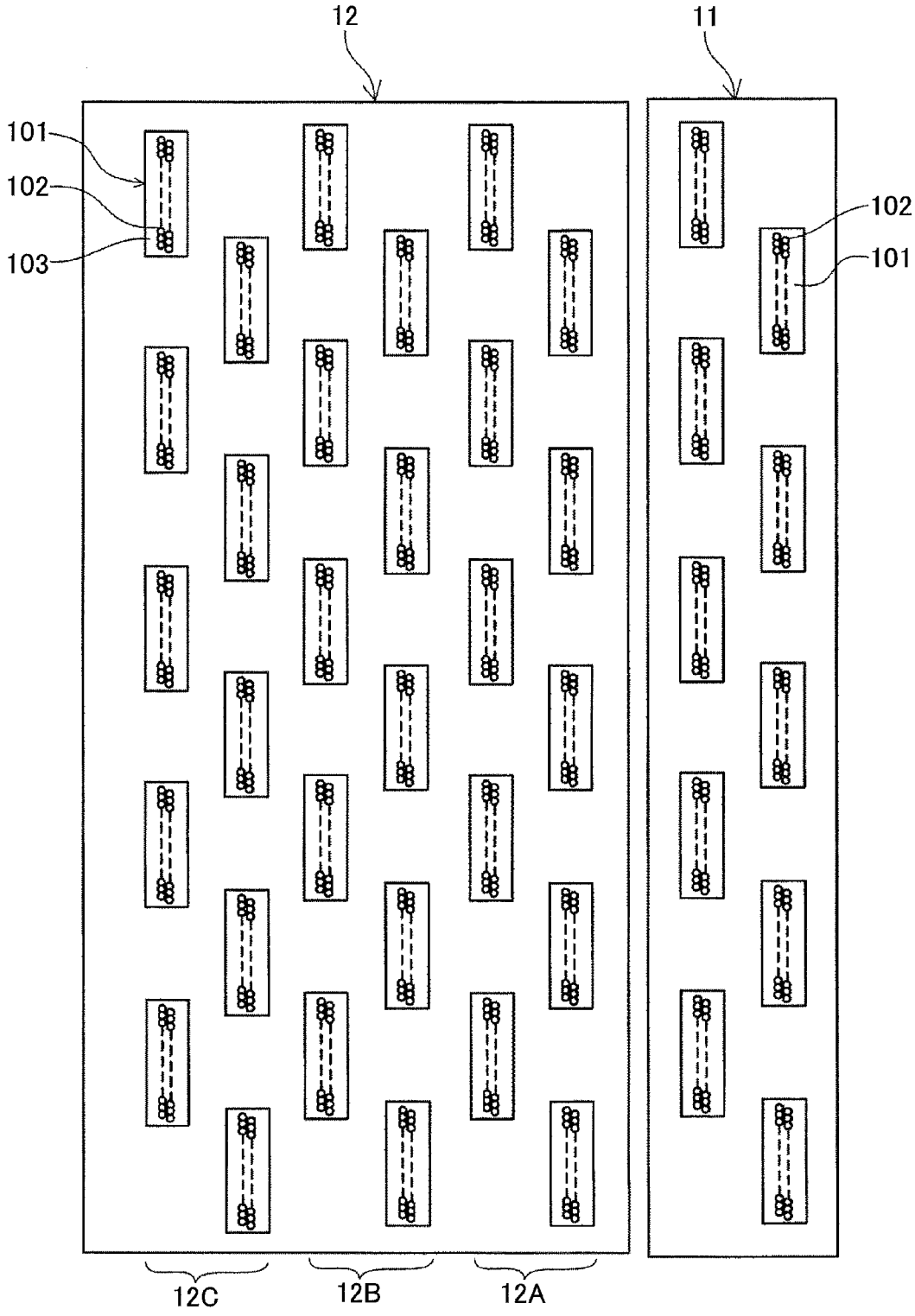
FIG. 3 is an explanatory diagram showing a recording head unit.

A description is given below with regard to embodiments of the present invention with reference to the drawings. First, an image forming apparatus according to an embodiment of the present invention is described with reference to FIGS. 1-3. FIG. 1 is an overview diagram which explains an overall configuration of the image forming apparatus, FIG. 2 is a plan explanatory diagram of a main part of the overall configuration of the image forming apparatus, and FIG. 3 is a plan explanatory diagram (shown in a transparent manner) of recording head units of the same apparatus.

This image forming apparatus is a line-type image forming apparatus that includes an apparatus main body 1; a paper-supply tray 2 which holds sheets P and supplies the sheets P; a paper-discharge tray 3 which holds the discharged printed sheets P; a conveying unit 4 which conveys the sheets P from the paper-supply tray 2 to the paper-discharge tray 3; a black head unit 11 which is a first recording head unit for ejecting liquid droplets of a single color and a color head unit 12 which is a second recording head unit for ejecting liquid droplets of multiple colors (both collectively called "recording head units 10"), which eject liquid droplets onto the sheets P conveyed by the conveying unit 4 for printing; a first maintenance apparatus 51 which is a maintenance and restoring mechanism for maintenance and restoring (restoring operation) of heads of the black head unit 11; and a second maintenance apparatus 52 which maintains and restores the heads of the color head unit 12.

The apparatus main body 1 includes front and rear side plates, a stay, etc. (not shown), and the sheets P loaded onto the paper-supply tray 2 are supplied to the conveying unit 4 sheet by sheet by means of a separation roller 21 and a paper supply roller 22.

The conveying unit 4 includes a conveying driving roller 41A and a conveyor driven roller 41B, and an endless conveying belt 43 which is wound between the rollers 41A and 41B. On a surface of this conveying belt 43 are formed, in a width direction, multiple discontinuous absorption bores, and at the lower portion of the conveying belt 43 is arranged an absorbing fan 44 which absorbs sheets P. Moreover, at the upper portions of the conveying drive roller 41A and the conveying driven roller 41B, respectively corresponding conveying guide rollers 42A and 42B abut against the belt 43 by self weight, while being held by a guide (not shown). Moreover, on the back side of the conveying belt 43 is arranged a platen member 45.

The conveying drive roller 41A is rotated by a motor (not shown), so that the conveying belt 43 moves by circular rotation, the sheet P is attracted onto the conveying belt 43 by an absorbing fan 44, and is conveyed by a circular rotational movement of the conveying belt 43. The conveying driven roller 41B and, the conveying guide rollers 42A and 42B rotate following the conveying belt 43.

As shown in FIG. 3, the black head unit 11 is a recording head unit (a head array), in which is formed a width of nozzle columns that corresponds to one line using ten of heads 101 in total, the ten of the heads 101 including five of the heads 101 arranged in each of two rows in a staggered fashion in a nozzle arrangement direction, each of the heads 101 having two of nozzle columns, each of the nozzle columns having multiple nozzles 102 arranged, each of the nozzles 102 ejecting liquid droplets. As described earlier, this black head unit 11 ejects liquid droplets of black color (black; K).

As shown in FIG. 3, the color head 12 has a group of head columns 12A, 12B, and 12C that forms a width of nozzle columns corresponding to one line using ten of the heads 101 in total, the ten of the heads 101 including five of the heads 101 arranged in each of two rows in a staggered fashion in the nozzle arrangement direction, each of the heads 101 having two of the nozzle columns arranged, each of the nozzle columns having multiple of the nozzles 102 arranged, each of the nozzles 102 ejecting liquid droplets. Each of the groups of head columns 12A, 12B, and 12C of this color head unit 12 ejects liquid droplets of respective colors of cyan (C), magenta (M), and yellow (Y), for example.

The line configuration of the colors is not limited to the above, and arrangement of the colors is also not particularly limited. Here, the black head unit 11 which ejects liquid droplets of black color is arranged upstream of the color head unit 12 in the conveying direction.

Moreover, the black head unit 11 and the color head unit 12 are independently raised and lowered by a unit which moves in upward and downward directions (not shown; a unit which moves a head unit).

Furthermore, while not shown, the black head unit 11 and the color head unit 12 are provided with a distributing member which distributes ink of a required color to each of the heads 101 in a manner such that it corresponds to the head column (or the group of head columns); a sub tank (not shown) is provided upstream of the distributing member, forming negative pressure due to hydraulic head difference between the sub tank and the corresponding heads 101; and, in addition, a main tank (not shown) which stores the ink is arranged upstream of the sub tank.

The first maintenance apparatus 51 includes a cap unit 501 which caps a nozzle face 103 of each of the heads 101 of the black head unit 11, a wiper unit 502 which wipes off the nozzle face 103, etc. Moreover, a second maintenance apparatus 52 includes the cap unit 501 which caps the nozzle face 103 of each of the heads 101 of the color head unit 12.

Here, the first maintenance apparatus 51 is movable along the conveying direction and has upstream of the black head unit 11 in the conveying direction as a receding position. The second maintenance apparatus 52 is movable along the conveying direction and has downstream of the color head unit 12 in the conveying direction as the receding position. These first and second maintenance apparatuses 51 and 52 have a below-described sliding unit which moves the cap units 501, etc., in the medium conveying direction and a forward and backward movement unit which moves each of the head units 51 and 52 in forward and backward directions relative to the nozzle face 103.

The ejecting performance of the head 101 is restored by absorbing ink within the head 101 in an absorbing unit (not shown) with the nozzle face 103 of the head 101 being sealed in the cap unit 501 of the first maintenance apparatus 51. Moreover, while the absorbing unit is described herein as a unit in maintenance, the ink may be discharged from the nozzle 102 by pressurizing the ink upstream of the black head unit 11 by a pressurizing unit.

The paper-discharge tray 3 includes a pair of side fences 31 which regulates the width direction of the sheet P and an end fence 32 which regulates a tip of the sheet P.

Figure 4A:
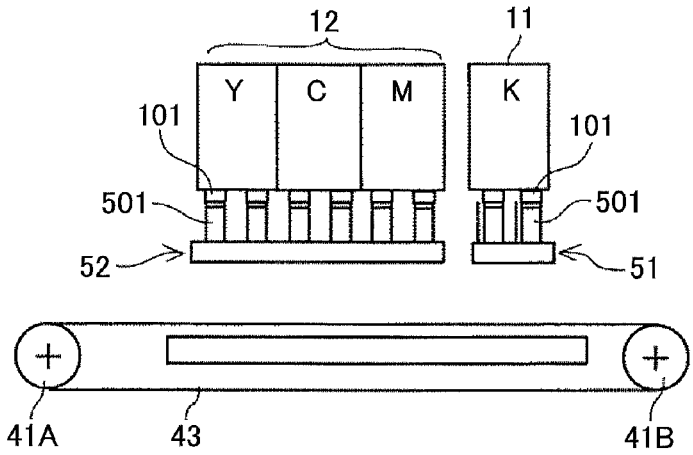
FIGS. 4A to 4C are explanatory diagrams which serve to explain operations of each of the recording head units and each of maintenance apparatuses.

Next, operations of the recording head units and the maintenance apparatuses are described with reference to FIGS. 4A-4C. First, as shown in FIG. 4A, when in a wait state, the first maintenance apparatus 51 caps the black head unit 11 and the second maintenance apparatus 52 caps the color head unit 12, keeping each of the heads 101 in a moisturized state. Moreover, such a state makes it possible to, first, perform maintenance operations on the head units 11 and 12 using absorption and pressurizing, and non-contributing ejection on the cap units 501.

Figure 4B:
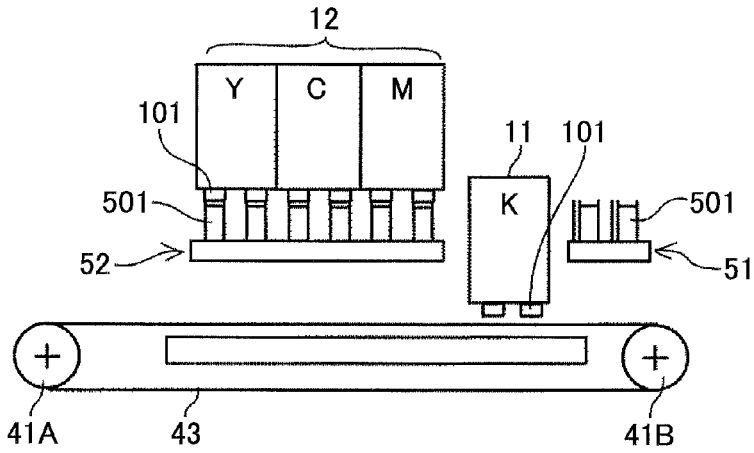

Moreover, when a monochromatic image is formed, as shown in FIG. 4B, a position (moisturized position) at which the second maintenance apparatus 52 caps the color head unit 12 is taken, the first maintenance apparatus 51 recedes upstream of the black head unit 11, and only the first recording head 11 is in a state such that it is lowered to a height position at which a predetermined gap (e.g., 1 mm) is formed relative to a sheet conveying face, so that liquid droplets of a required color are ejected onto the sheet P conveyed by the conveying belt 43 to form the monochrome image.

Figure 4C:
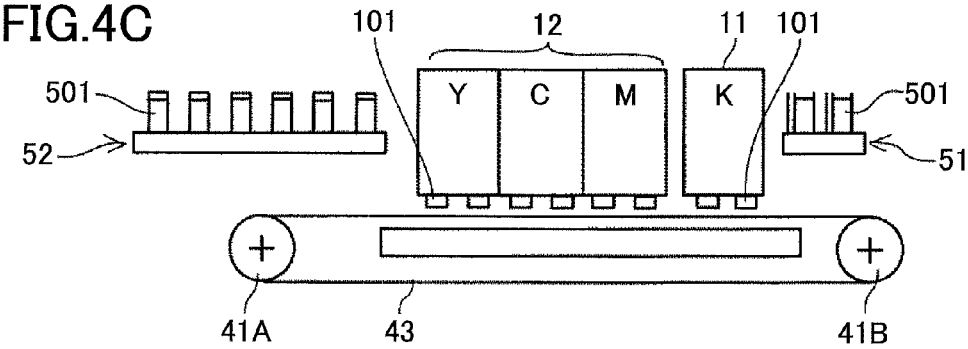

Furthermore, when a full-color image is formed, as shown in FIG. 4C, the first maintenance apparatus 51 recedes upstream of the black head unit 11, the second maintenance apparatus 52 recedes downstream of the color head unit 12, and the first recording head 11 and the second recording heads 12 are lowered to a height position at which a predetermined gap (e.g., 1 mm) is formed relative to a sheet conveying face, so that liquid droplets of required colors are ejected onto the sheet P conveyed by the conveying belt 43 to form the monochrome image.

Figure 5:
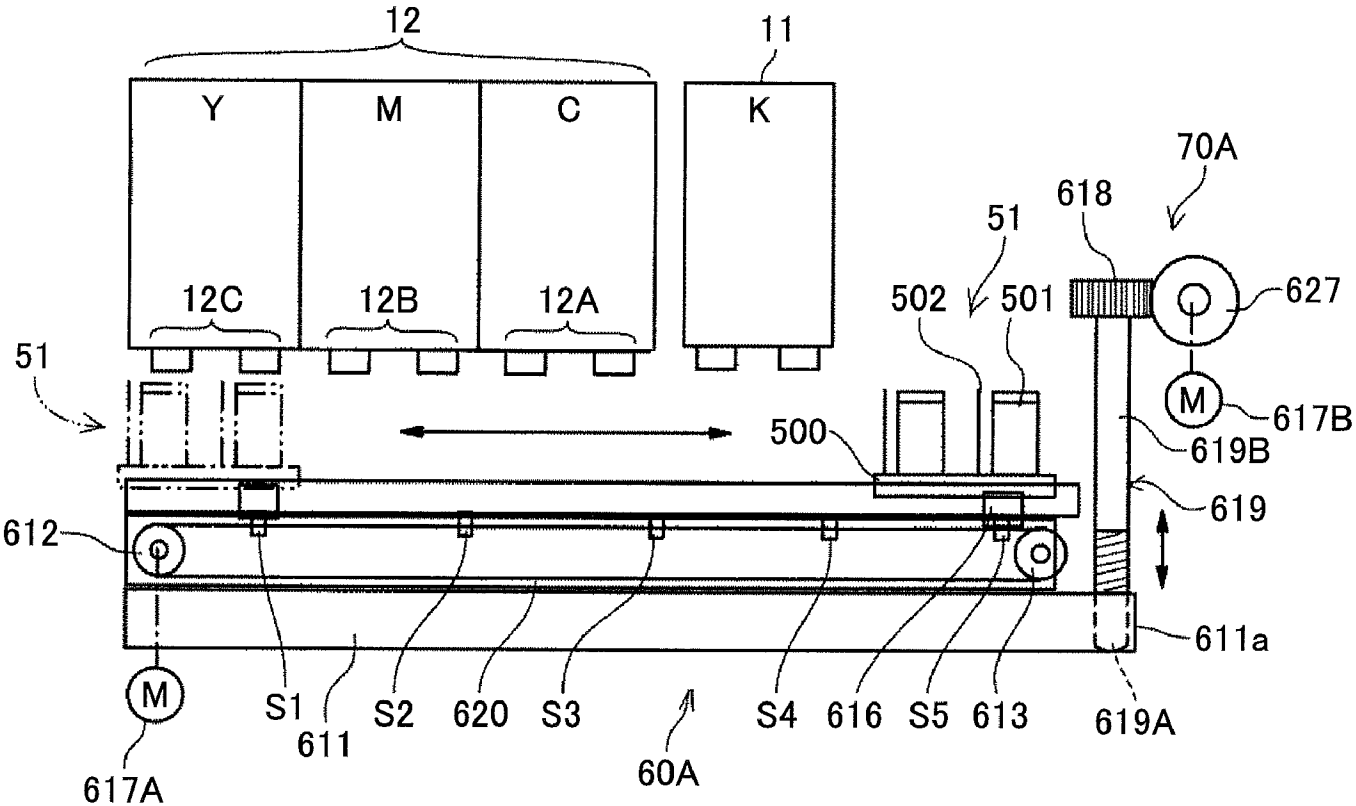
FIG. 5 is an explanatory diagram which serves to explain a moving unit of a first maintenance apparatus.

Next, a unit which moves the first maintenance apparatus is described with reference to FIG. 5. The first maintenance apparatus 51 is loaded with the above-described cap unit 501 and a wiper unit 502 on a slider 510. To the cap unit 501 is connected an absorbing unit, for example.

Then, a slider moving unit 60A which moves the first maintenance apparatus 51 in the sheet conveying direction includes pulleys 612 and 613; a belt 620 wrapped to the pulleys 612 and 613; a fixing member 616 which fixes a base 510 to a part of the belt 620; a base member 611 which supports the slider 510 while rotatably supporting the pulleys 612 and 613; and a maintenance moving motor 617A which serves as an actuating unit which rotatably actuates the pulley 612.

The slider 510 of the first maintenance apparatus 51 is arranged such that it moves in the belt moving direction when the maintenance moving motor 617A operates, so that the pulley 612 is rotationally actuated to circularly move the belt 620. The belt 620 is arranged such that the slider 510 can move from a receded position via the black head unit 11 to the color head unit 12 in the sheet conveying direction X.

The movement position of the first maintenance apparatus 51 is detected by detecting sensors S1-S5, which are arranged on a moving orbit of the fixing member 616. The detecting sensor S1 detects a first opposing position which opposes a head column group 12C of the color head unit 52, the detecting sensor S2 detects a second opposing position which opposes a head column group 12B, the detecting sensor S3 detects a third opposing position which opposes a head column group 12A, the detecting sensor S4 detects a fourth opposing position which opposes a black head unit 51, and the detecting sensor S5 detects a receded position which opposes neither the color head unit 52 nor the black head unit 51.

On one edge 611*a* of the base member 611 is screwed one edge 619A of a shaft with a screw 619 to be an actuating axis extending in upward and downward directions as shown. To the other edge 619B of the shaft 619 is fixed a gear 618 which meshes with an actuating gear 627, which is rotationally actuated by a maintenance moving motor 617B which includes a stepping motor. The actuating gear 627, the gear 618, the shaft 619, and the maintenance moving motor 617B make up a forward and backward moving unit 70A.

At the forward and backward moving unit 70A, when the maintenance moving motor 617B operates so that the actuating gear 627 rotates, the shaft 619 rotates via the gear 618 to move the base member 611 in upward and downward directions as shown. The moving direction may be effected by rotating, in normal and reverse directions, the rotating direction of the maintenance moving motor 617B. For example, the slider 510 can move to an opposing position when the maintenance moving motor 617B rotates in a normal direction and move from the opposing position to the capping position at which it abuts against the nozzle faces 103 of the head unit 51 or 52 to perform capping. Detecting the opposing position and the capping position may be controlled using the number of pulses when the maintenance moving motor 617B is configured with the stepping motor, or may be detected with a separately provided sensor, etc., when the stepping motor is not used.

Then, when performing pressurizing maintenance as a restoring operation, the first maintenance apparatus 51 moves below head column groups 12A-12C of the black head unit 11 or the color head unit 12 and is instructed to execute the restoring operation. Then, a subtank (not shown) is pressurized, so that ink is discharged from a head 101 in a pressurized manner, which ink discharged in the pressurized manner is discharged within the cap unit 501. The cap unit 501 absorbs the ink by an absorbing pump (not shown) and discharges the ink to a waste liquid tank (not shown). Then, the wiper unit 502 wipes off the nozzle face 103 of the head 101 to wipe off excess ink and form a nozzle meniscus.

Moreover, when performing absorbing maintenance, the first maintenance apparatus 51 moves below head column groups 12A-12C of the black head unit 11 or the color head unit 12 which is instructed to execute restoring. Then, the first maintenance apparatus 51 is raised, so that the cap unit 501 abuts against the nozzle face 103 of the head 101, forms negative pressure within the cap unit 501 with the absorbing pump (not shown) to absorb the ink from the head 101 and discharges the absorbed ink to the waste liquid tank. Then, the wiper unit 502 wipes off the nozzle face 103 of the head 101 to wipe off the excess ink and forms the nozzle meniscus.

Wiping-off conditions are set such that, by raising the first maintenance apparatus 51, wiper pressing force can be changed and the number of times of wiping off can also be changed.

Figure 6:
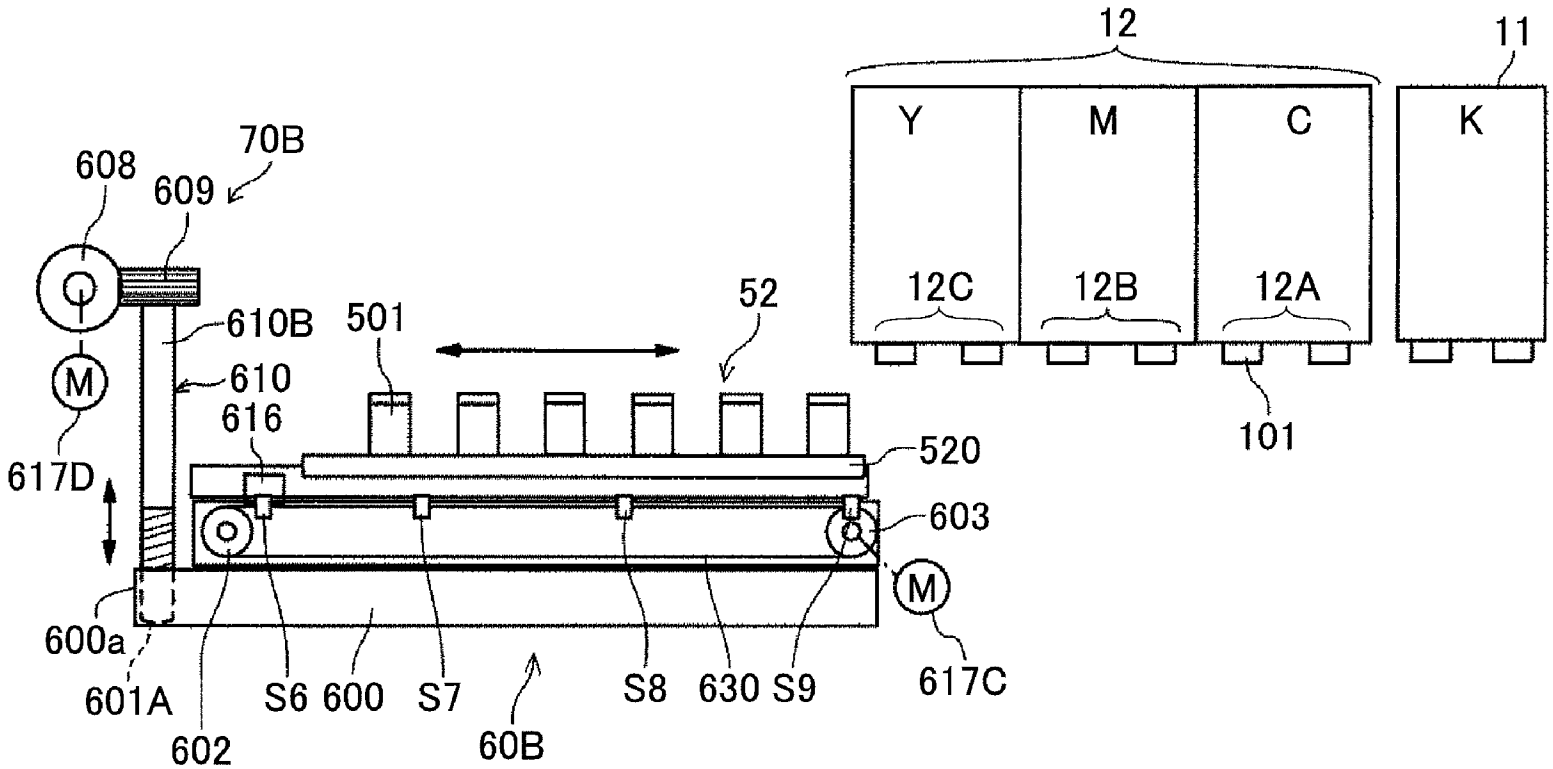
FIG. 6 is an explanatory diagram which serves to explain a moving unit of a second maintenance apparatus.

Next, a unit which moves the second maintenance apparatus 52 is described with reference to FIG. 6. The second maintenance apparatus 52 is loaded with the above-described cap unit 501 on a slider 520.

Then, a cap moving unit 60B which moves the second maintenance apparatus 52 includes pulleys 602 and 603; a belt 630 wrapped to the pulleys 602 and 603; a fixing member 601 which fixes a color cap 6*b* to a part of the belt 630; a base member 600 which supports the color cap 6*b* while rotatably supporting the pulleys 602 and 603; and a maintenance moving motor 617C which serves as an actuating unit which rotatably actuates the pulley 603.

The slider 520 is moved in the belt moving direction when the pulley 603 is rotationally actuated by the operation of the maintenance moving motor 617C, so that the belt 630 moves circularly. The belt 630 slidably moves the slider 520 between the color head unit 12 and the receded positions in left and right directions as shown.

The moving range of the second maintenance apparatus 52 is set to be a range from the receded position which does not oppose head column groups 12A-12C of the color head unit 12 to the opposing position which opposes all of the head column groups 12A-12C of the color head unit 12. The movement position of the second maintenance apparatus 52 is detected by detecting sensors S6-S10, which are arranged on a moving orbit of the fixing member 601.

The detecting sensor S6 detects the receded position which opposes none of the head column groups 12A-12C of the color head unit 12, the detecting sensor S7 detects a fifth opposing position which opposes the head column group 12C, the detecting sensor S8 detects a sixth opposing position which opposes the head column group 12B, and the detecting sensor S9 detects a seventh opposing position which opposes the head column group 12A.

On one edge 600*a* of the base member 600 is screwed one edge 610A of a shaft with a screw 610 to be an actuating axis extending in upward and downward directions as shown. To the other edge 610B of the shaft 610 is fixed a gear 609 which meshes with an actuating gear 608, which is rotationally actuated by a maintenance moving motor 617D which includes a stepping motor. The actuating gear 608, the gear 609, the shaft 610, and the maintenance moving motor 617D make up a forward and backward moving unit 70B.

At the forward and backward moving unit 70B, when the maintenance moving motor 617D is activated so that the actuating gear 608 rotates, the shaft 610 rotates via the gear 609 to move the base member 600 in upward and downward directions as shown. The moving direction may be effected by changing, in normal and reverse directions, the rotating direction of the maintenance moving motor 617D. The second maintenance apparatus 52 is arranged such that it can move from an opposing position to a cap position at which the cap unit 501 abuts against the nozzle face 103 of the head 101 when the maintenance moving motor 617D rotates in the normal direction, for example. The positional detection of the opposing position and the cap position may be controlled using the number of pulses when the maintenance moving motor 617D is configured with the stepping motor, or may be detected with a separately provided sensor, etc., when the stepping motor is not used.

Figure 7:
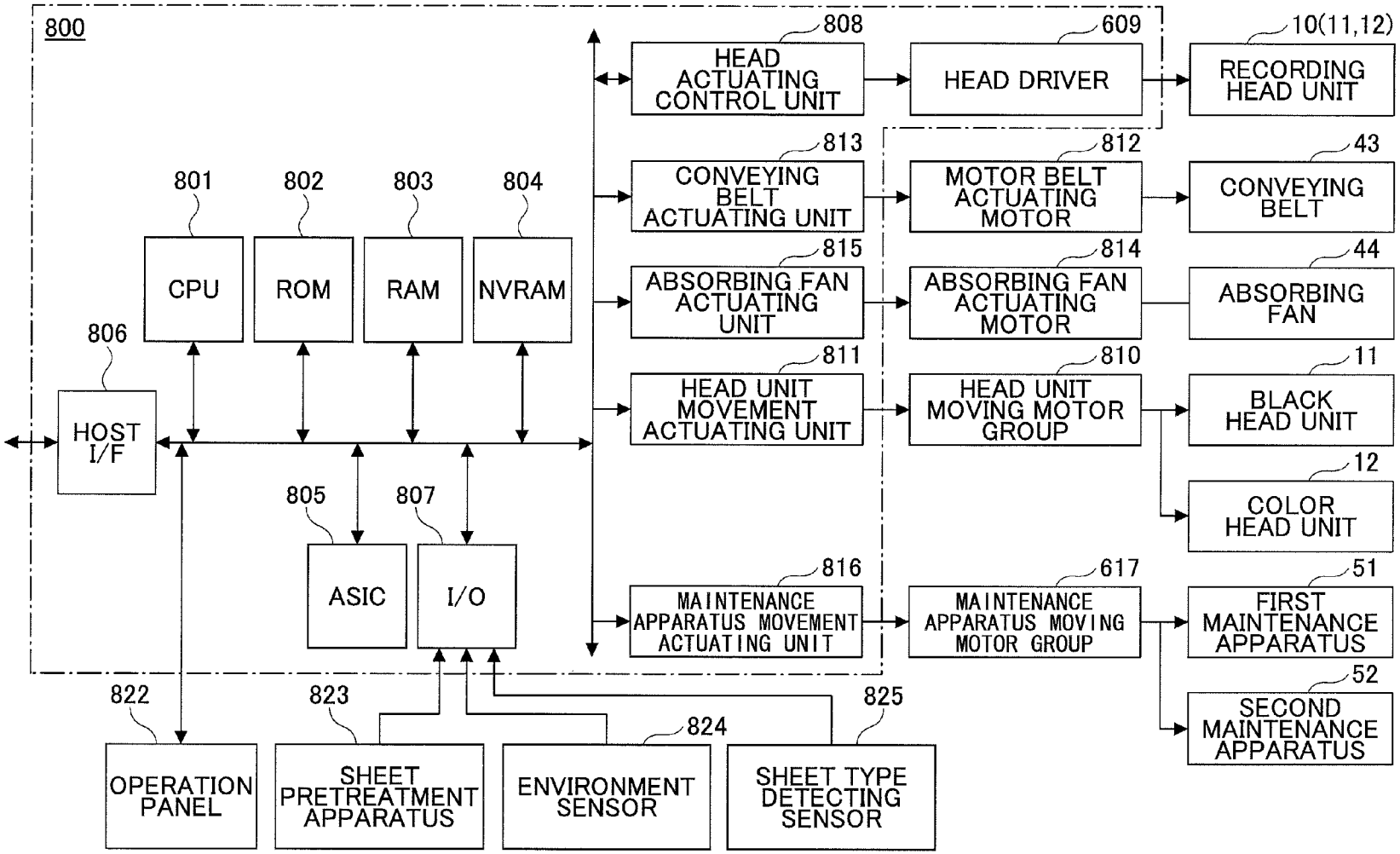
FIG. 7 is a block explanatory diagram which serves to explain an overview of a control unit of the image forming apparatus.

Next, an overview of a control unit of the image forming apparatus is described with reference to FIG. 7, which is an explanatory block diagram.

A control unit 800 includes a CPU 801 which controls the overall image forming apparatus; a ROM 802 which also serves as a storage unit in the present invention for storing various programs including a program which also serves as a counting unit which counts the cumulative number of print sheets and cumulative printing time according to the present invention that is executed by the CPU 801, and a program which also serves as a restoring control unit which controls restoring operations and other fixed data; a RAM 803 which temporarily stores image data, etc.; a non-volatile memory (NVRAM) 804 for holding data for even the time during which power of the apparatus is shut down; an ASIC 805 which processes input and output for controlling the entirety of other apparatuses; a host I/F 806 for receiving data and signals from the host; an I/O 807; and a head actuating control unit 808 and a head driver 809 for actuating control of the heads 101 of the black head unit 11 and the color head unit 12.

Moreover, the control unit 800 includes a head unit movement actuating unit 811 which actuates a head unit moving motor group 810 which raises and lowers the black head unit 11 and the color head unit 12; a conveying belt actuating unit 813 which actuates the conveying belt actuating motor 812 for moving the conveying belt 43; an absorbing fan actuating unit 815 which actuates an absorbing fan motor 814 which actuates an absorbing fan 44; and a maintenance unit movement actuating unit 816 which actuates a motor group 617 (motors 617A-617D) which moves the first maintenance apparatus 51 and the second maintenance apparatus 52.

Moreover, into the I/O 807 of the control unit 800 are input detection signals from various sensors such as the above-described sensors S1-S9; a sheet pretreatment detecting sensor 823 which detects whether there is a connection of a treatment solution applying apparatus (not shown) which applies a pretreatment solution onto the sheets P; an environment sensor 824 which detects environment temperature and environment humidity of an apparatus; and a sheet type detecting sensor 825 which detects the type of the sheet P, etc.

Furthermore, the control unit 800 conducts outputting and inputting of required information with an operations panel 822.

This control unit 800 receives, at the host I/F 806 via a cable or a network, print data, etc., including image data from the host side such as an information processing apparatus including a personal computer (below called a PC) etc., an image reading apparatus including an image scanner, etc., and an imaging apparatus including a digital camera, etc.

The CPU 801 reads print data within a receive buffer included in the host I/F 806 to analyze the data, and sorts the data at the ASIC 805 to transfer image data to the head actuating control unit 808. For conversion to bit map data for the print data (i.e., print raster data) for image outputting, font data may be stored in the ROM, for example, or image data may be developed into bit map data to create the bit map data for the print data (i.e., the print raster data), which print raster data may be transferred to this apparatus.

Upon receiving the print raster data, the head actuating control unit 808 sends the dot pattern data (the print raster data) to the head driver 809 in synchronization with a clock signal and also sends a latch signal to the head driver 809 at a predetermined timing. The head actuating control unit 808 includes an actuating waveform generating circuit which includes a waveform generating circuit, an amplifier, etc., the waveform generating circuit including a ROM (which may be configured with the ROM 802) which stores pattern data of the actuating waveform (actuating signal) and a D/A converter which D/A converts actuating waveform data read from the ROM.

Moreover, the head driver 809 includes a shift register to which is input serial data being image data and a clock signal from the head actuating control unit 808; a latch circuit which latches, with a latch signal from the head actuating control units a register value of the shift register; a level converting circuit (a level shifter) which changes the level of an output value of the latch circuit; and an analog switch array (a switch unit), which is on/off controlled with the level shifter, etc., and on/off of the analog switch array is controlled to selectively apply a required actuating waveform included in an actuating waveform to an actuator unit of each head 101 of the recording head unit 10 and print image data to form a dot pattern line.

Here, a first setting value of the cumulative number of print sheets P by the black head unit 11 and the color head unit 12 that are to be thresholds for conducting restoring operations and a second setting value which is smaller than the first setting value are stored. A restoring operation which is executed when the cumulative number of print sheets reaches the first setting value or above is called "periodic maintenance". It may be arranged such that the first and second setting values may be changed from an information processing apparatus on the host side or the operations panel 822.

Now, control of restoring operations (maintenance processes) according to the present invention by the control unit is described with reference to FIGS. 8-11.

Figure 8:
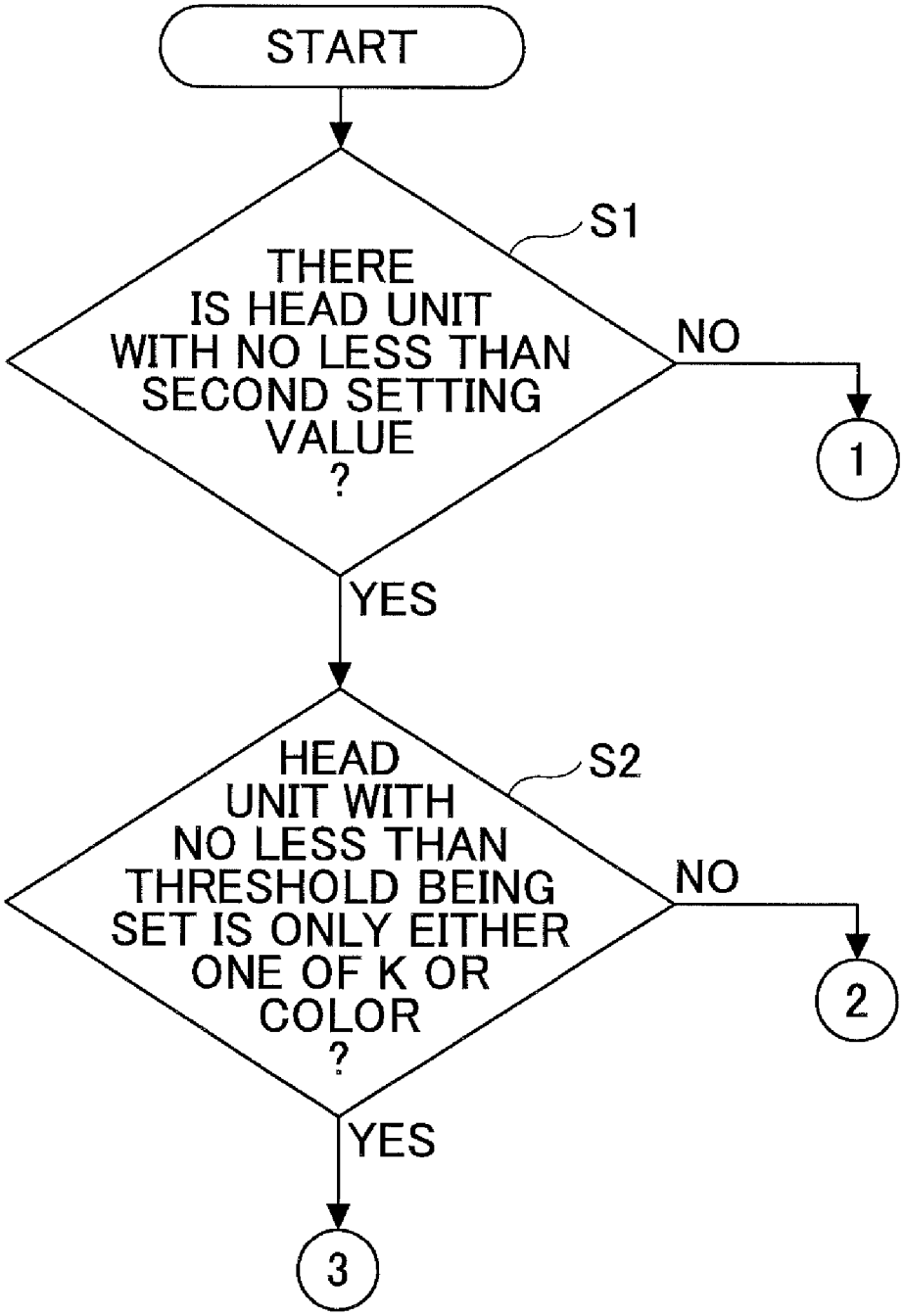
FIG. 8 is a flowchart which serves to explain restoring operation control (maintenance process) by the control unit.

First, with reference to FIG. 8, when the control unit 800 is instructed to execute (or start) printing, it is determined whether there is a head unit (the black head unit 11 or the color head unit 12) with the cumulative number of print sheets of no less than the second setting value (step S1, merely called "S1" below). The cumulative number of print sheets is a count value of the number of print sheets that is reset and restarted with the condition that a restoring operation has been performed.

Figure 9:
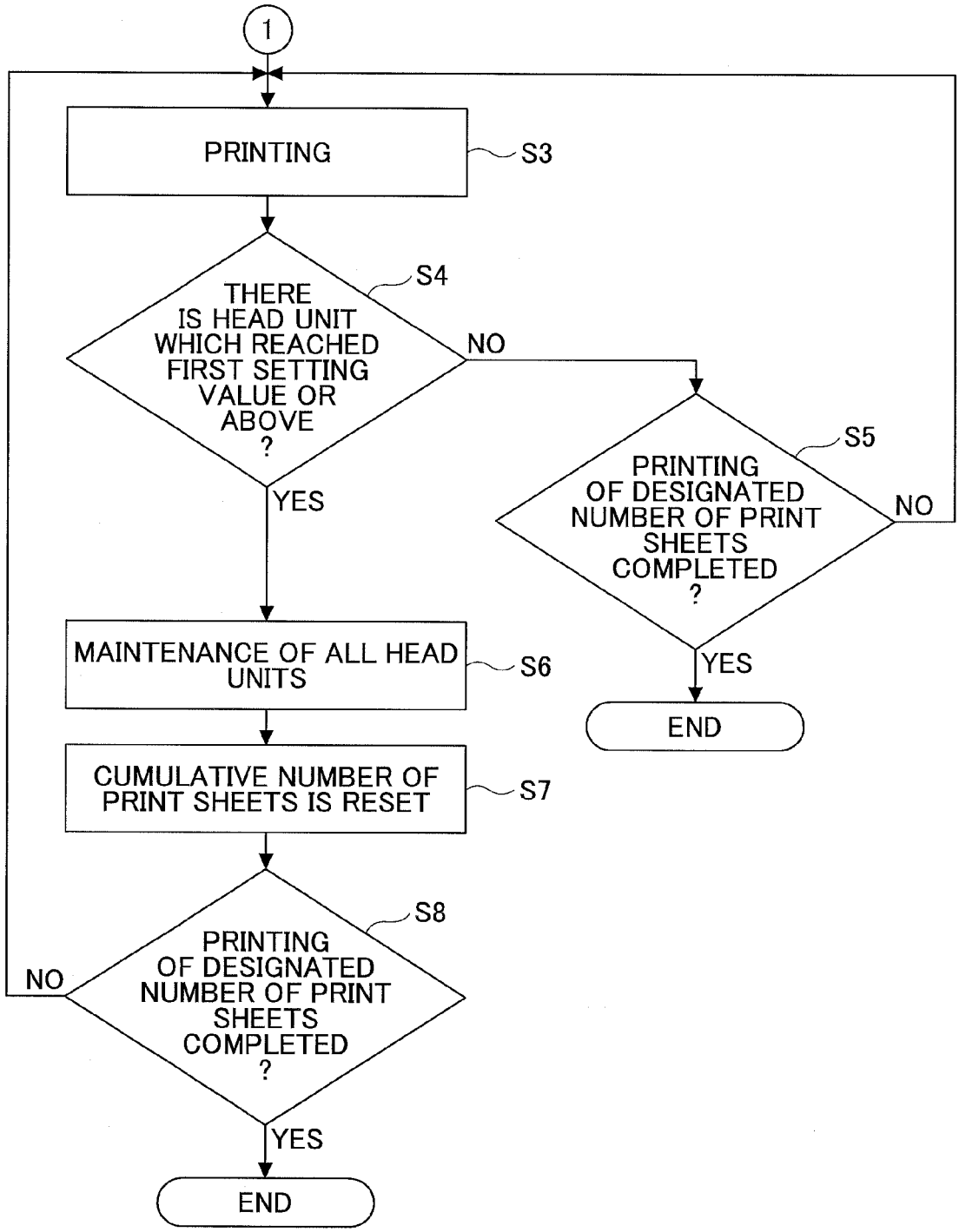
FIG. 9 is a flowchart which serves to explain the process as a continuation of FIG. 8.

Here, when there is no head unit with the cumulative number of print sheets of no less than the second setting value, in other words, when the cumulative numbers of print sheets for the black head unit 11 and for the color head unit 12 are both less than the second setting value, the process transfers to the process shown in FIG. 9. On the other hand, when there is a head unit with the cumulative number of print sheets of no less than the second setting value, it is determined whether the head unit with the cumulative number of print sheets of no less than the second setting value is either one of the black head unit 11 and the color head unit 12 (S2).

Figure 10:
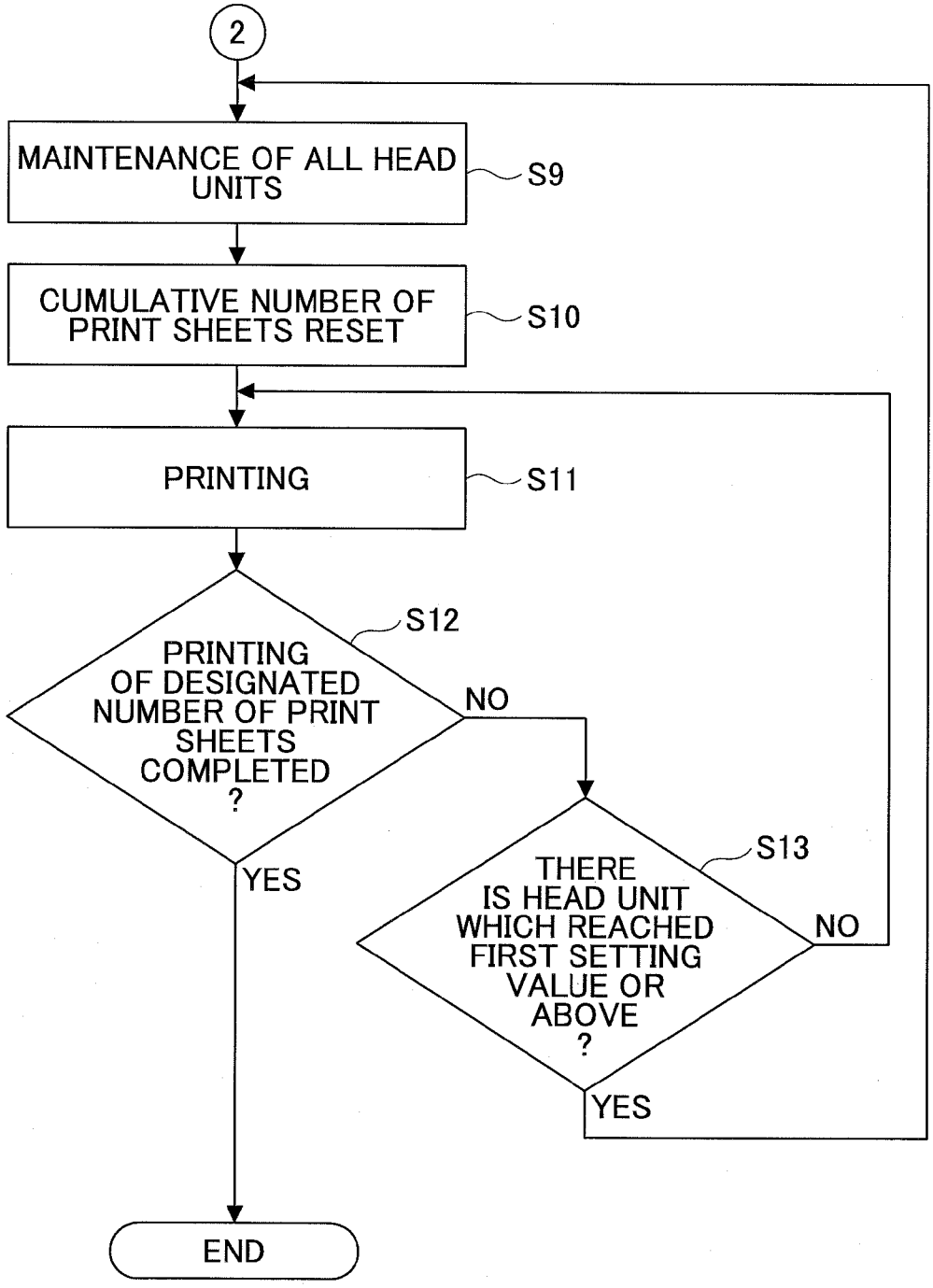
FIG. 10 is another flowchart which serves to explain the process as another continuation of FIG. 8.

Then, if no, or in other words, both the black head unit 11 and the color head unit 12 have the cumulative number of print sheets of no less than the second setting value, the process transfers to the process shown in FIG. 10. If either the black head unit 11 or the color head unit 12 has the cumulative number of print sheets of no less than the second setting value, the process transfers to the process in FIG. 11.

Next, with reference to FIG. 9, when the cumulative numbers of print sheets of all of the head units 11 and 12 at the start of printing is less than the second setting value, printing is executed based on printing instructions (S3). At this time, the number of print sheets is counted by the cumulative number of print sheets counting unit.

Then, it is determined whether the cumulative number of print sheets has reached the first setting value or above for at least one of the head units 11 and 12 (S4). At this time, if neither of the cumulative numbers of print sheets for the head units 11 and 12 reaches the first setting value, it is determined whether printing of the designated number of print sheets has been completed (S5) and the process returns to step S3 as long as the printing of the designated number of print sheets is not completed. In this way, if neither of the cumulative numbers of print sheets for the head units 11 and 12 reaches the first setting value or the above before the printing of the designated number of print sheets is completed, the printing operation is completed.

On the other hand, if either of the cumulative numbers of the print sheets for the head units 11 and 12 reaches the first setting value or the above before the printing operation is completed, the restoring operation is performed on both of the head units 11 and 12 (S6). Thereafter, the count value for the cumulative number of print sheets is reset (S7). Then, it is determined whether printing of the designated number of print sheets has been completed (S8), and the process returns to step S3 as long as the printing of the designated number of print sheets is not completed.

In other words, when the cumulative numbers of print sheets for all of the recording heads are less than the second setting value at the time of starting the printing, a restoring operation is conducted for all of the recording heads when either of the cumulative numbers of print sheets for the recording heads reaches the first setting value or the above. In this way, the cumulative numbers of print sheets for all of the recording heads may be aligned prior to reaching the first setting value for conducting periodic maintenance, and subsequent periodic maintenance intervals may be made uniform so as to decrease the number of times periodic maintenance is executed during printing, making it possible to reduce printing time.

For example, with the first setting value for conducting the periodic maintenance of 5000, and the second setting value, which is smaller than the first value, of 2500, when both of the cumulative number of print sheets of the black head unit 11 and the color head unit 12 are less than 2500 at the time of starting printing, the restoring operation is conducted for both the black head unit 11 and the color head unit 12 when either of the black head unit 11 and the color head unit 12 reaches 5000, which is the first setting value, in a subsequent printing operation. In this way, the previous cumulative number of print sheets is reset and counting of the cumulative number of print sheets is started for both of the black head unit 11 and the color head unit 12, making it possible to align the number of remaining print sheets before executing periodic maintenance.

Next, with reference to FIG. 10, when both of the cumulative numbers of print sheets for all of the head units 11 and 12 are no less than the second setting value at the time of the starting the printing, restoring operation is conducted for both of the heads 11 and 12 (maintenance of all head units, S9). Thereafter, the count value for the cumulative number of print sheets is reset (S10).

Then, the printing operation is conducted (S11); it is determined whether the printing of the designated number of print sheets has been completed (S12); if no, it is determined whether the cumulative number of print sheets has reached the first setting value (S13); and, if the cumulative number of print sheets has reached the first setting value before the printing of the designated number of print sheets has completed, the process returns to step S9, conducting restoring operations for all of the head units 11 and 12, and completing the process when the printing of the designated number of print sheets is completed.

In this way, when the cumulative numbers of print sheets for all of the head units are no less than the second setting value before starting printing, a restoring operation is conducted for all of the head units before starting printing to align the remaining number of print sheets up to the first setting value, making it possible to reduce the number of times periodic maintenance is executed during printing and to shorten the printing time.

Figure 11:
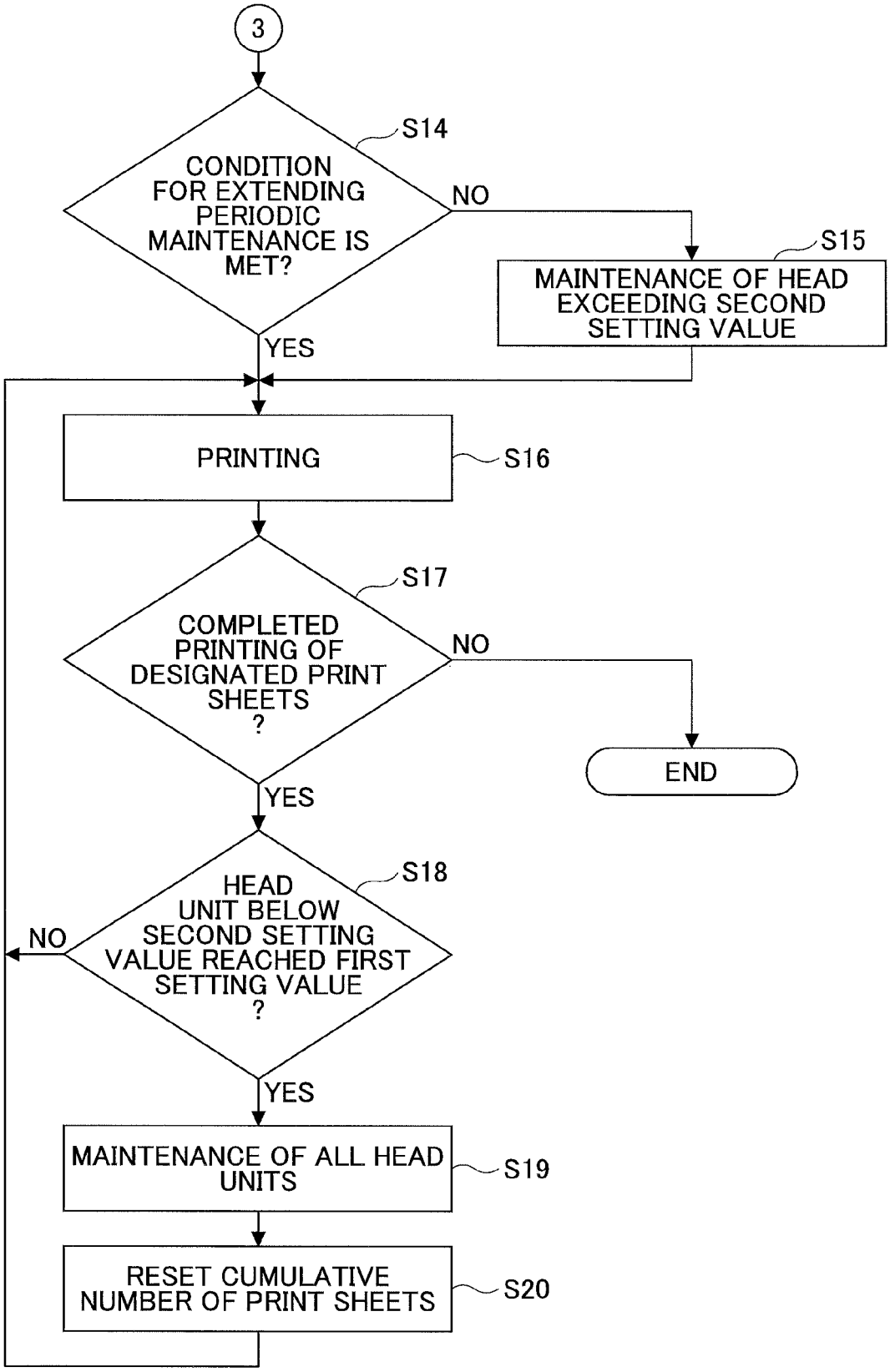
FIG. 11 is yet another flowchart which serves to explain the process as yet another continuation of FIG. 8.

Next, with reference to FIG. 11, if the cumulative number of print sheets is no less than the second setting value for either of the head units 11 and 12 at the time of starting printing, it is determined whether a condition is met for extending the term for executing periodic maintenance.

As one example of the condition which makes it possible to extend the term for periodic maintenance, there is a case such that a sheet pretreatment unit is provided which applies, onto the sheets, a treatment solution for enhancing the fixability of the ink. The sheet pretreatment apparatus applies a pretreatment solution onto a plain paper sheet to coat the surface of the print sheet, making it possible to prevent print dot blotting and to improve the image quality. Moreover, the liquid is applied onto the surface of the sheet, also making it possible to prevent paper dust produced from the sheet from scattering. Therefore, pretreatment is conducted onto the sheets in continuous printing, making it possible to prevent paper dust from adhering to the nozzle face and to increase the periodic maintenance interval.

Moreover, another example may be a case such that the environment humidity is high. An increased ambient humidity leads to decreased scattering of the paper dust, making it possible to prevent the paper dust from adhering to the nozzle face and to increase the periodic maintenance interval.

Furthermore, a further example may be a case such that paper which does not produce paper dust is used. The use of the paper which does not produce paper dust means the use of surface-coated paper, or the use of a sheet or film made of resin.

Here, when the condition is not met which makes it possible to extend the periodic maintenance, restoring operation is conducted for the head unit 11 or 12 exceeding the second setting value before starting printing (S15). Thereafter, printing is conducted (S16); it is determined whether printing of the designated number of print sheets has been completed (S17); and the printing operation is completed if the printing of the designated number of print sheets is completed before reaching the first setting value.

Moreover, before printing of the designated number of print sheets is completed, it is determined whether the cumulative number of print sheets for the head unit previously below the second setting value has reached the first setting value (S18), and, if yes, a restoring operation is conducted for the head units 11 and 12 (S19), the cumulative number of print sheets is reset (S20), and the process returns to the printing operation of step 19.

In this way, when the cumulative number of print sheets is no less than the second setting value for either of the head units 11 and 12 at the time of starting printing, a restoring operation is conducted for the head unit with the cumulative number of print sheets of no less than the second setting value, and thereafter a restoring operation is conducted when the head unit with the cumulative number of print sheets below the second setting value at the time of starting printing has reached the first setting value or above, so that subsequent periodic intervals are made uniform, making it possible to decrease the number of times the periodic maintenance is executed during printing and to achieve a shortened printing time.

As described above, the present embodiment may result in a head unit for which a restoring operation (maintenance operation) is executed earlier than the original maintenance setting value (the first setting value) in order to make the maintenance interval uniform. In this case, the periodic maintenance is conducted even when the other head unit can conduct continuous printing, so that the ink ends up being wastefully used by maintenance. Moreover, wiping off causes the head face to rub, so it is anticipated that the surface treatment of the head nozzle face may deteriorate earlier than usual.

Thus, when conducting maintenance before the setting value for the periodic maintenance is reached, or in other words, in a restoring operation which is conducted before the first setting value is reached, it is preferable to conduct the restoring operation (maintenance) which decreases the amount of ink used. For maintenance schemes of either pressurizing or absorbing, maintenance can be conducted at pressure lower than a normal pressure value to decrease the amount of ink discharged. Moreover, with respect to wiping off, the required wiping-off times and wiper unit pressing force may be set lower to reduce the loading on the nozzle face of the head.

The count value for the cumulative number of paper sheets, required amount of ink discharged, and wiping-off conditions may be pre-stored as a table in a storage unit such as the ROM 802, so that maintenance may be executed with optimum conditions with reference to the table at the respective maintenance times.

According to the above embodiment, the cumulative number of print sheets is used to control the timing of the restoring operation, but the cumulative printing time may also be used to effect similar control. Moreover, while explanations are made using an example of applying to a line-type image forming apparatus, a similar application may also be made to a serial-type image forming apparatus.

The present application is based on Japanese Priority Application No. 2010-206253 filed on Sep. 15, 2010, the entire contents of which are hereby incorporated by reference.

The invention claimed is:

1. An image forming apparatus, comprising:

at least two independent recording heads ejecting liquid droplets of different colors;

restoring units, each of the restoring units conducting a restoring operation of the recording heads;

counting units which count the cumulative number of print sheets printed using the recording heads since the restoring operation;

a restoring control unit which controls the restoring operation of the recording heads by the restoring units; and a storage unit which stores a first setting value of the cumulative number of print sheets that is to be a threshold for conducting the restoring operation, and a second setting value which is smaller than the first setting value, wherein the restoring control unit conducts the restoring operation for all of the recording heads when the cumulative number of print sheets of either of the recording heads reaches the first setting value or above when the cumulative number of print sheets for all of the recording heads is less than the second setting value at the time of starting printing.

2. The image forming apparatus as claimed in claim 1, wherein at least one of the restoring units includes:

a cap unit configured to cap a nozzle face of the corresponding recording head; and a wiper unit configured to wipe off the nozzle face of the corresponding recording head.

3. The image forming apparatus as claimed in claim 1, wherein at least one of the restoring units is configured to move along a sheet conveying direction and has a receding position located upstream of the recording heads in the sheet conveying direction, and at least another of the restoring units is configured to move along the sheet conveying direction and has a receding position located downstream of the recording heads in the sheet conveying direction.

4. The image forming apparatus as claimed in claim 1, wherein at least one of the restoring units includes:

a sliding unit configured to move the respective restoring unit along the sheet conveying direction; and a forward and backward movement unit configured to move the respective estoring unit in forward and backward directions relative to a nozzle face of the corresponding recording head.

5. An image forming apparatus, comprising:

at least two independent recording heads ejecting liquid droplets of different colors;

restoring units, each of the restoring units conducting a restoring operation of the recording head;

counting units which count the cumulative number of print sheets printed using the recording heads since the restoring operation;

a restoring control unit which controls the restoring operation of the recording heads by the restoring units; and a storage unit which stores a first setting value of the cumulative number of print sheets that is to be a threshold for conducting the restoring operation, and a second setting value which is smaller than the first setting value, wherein, when the cumulative number of print sheets for all of the recording heads is no less than the second setting value at the time of starting printing, the restoring control unit conducts the restoring operation for all of the recording heads without waiting for the first setting value to be reached.

6. The image forming apparatus as claimed in claim 5, wherein at least one of the restoring units includes:

a cap unit configured to cap a nozzle face of the corresponding recording head; and a wiper unit configured to wipe off the nozzle face of the corresponding recording head.

7. The image forming apparatus as claimed in claim 5, wherein at least one of the restoring units is configured to move along a sheet conveying direction and has a receding position located upstream of the recording heads in the sheet conveying direction, and at least another of the restoring units is configured to move along the sheet conveying direction and has a receding position located downstream of the recording heads in the sheet conveying direction.

8. The image forming apparatus as claimed in claim 5, wherein at least one of the restoring units includes:

a sliding unit configured to move the respective restoring unit along the heet conveying direction; and a forward and backward movement unit configured to move the respective restoring unit in forward and backward directions relative to a nozzle face of the corresponding recording head.

9. An image forming apparatus, comprising:

at least two independent recording heads ejecting liquid droplets of different colors;

restoring units, each of the restoring units conducting a restoring operation of the recording heads;

counting units which count the cumulative number of print sheets printed using the recording heads since the restoring operation;

a restoring control unit which controls the restoring operation of the recording heads by the restoring units; and a storage unit which stores a first setting value of the cumulative number of print sheets that is to be a threshold for conducting the restoring operation, and a second setting value which is smaller than the first setting value, wherein, the restoring control unit conducts the restoring operation for one of the recording heads with the cumulative number of print sheets no less than the second setting value when there is the one of the recording heads with the cumulative number of print sheets no less than the second setting value and another of the recording heads with the cumulative number of print sheets less than the second setting value at the time of starting printing and conducts the restoring operation for both of the recording heads when the other of the recording heads with the cumulative number of print sheets less than the second setting value reaches the first setting value or above.

10. The image forming apparatus as claimed in claim 9, wherein at least one of the restoring units includes:

a cap unit configured to cap a nozzle face of the corresponding recording head; and a wiper unit configured to wipe off the nozzle face of the corresponding recording head.

11. The image forming apparatus as claimed in claim 9, wherein at least one of the restoring units is configured to move along a sheet conveying direction and has a receding position located upstream of the recording heads in the sheet conveying direction, and at least another of the restoring units is configured to move along the sheet conveying direction and has a receding position located downstream of the recording heads in the sheet conveying direction.

12. The image forming apparatus as claimed in claim 9, wherein at least one of the restoring units includes:

a sliding unit configured to move the respective restoring unit along the sheet conveying direction; and a forward and backward movement unit configured to move the respective restoring unit in forward and backward directions relative to a nozzle face of the corresponding recording head.

* * * * *